US006101262A

United States Patent [19]

Haase et al.

[11] Patent Number: 6,101,262

[45] Date of Patent: Aug. 8, 2000

[54] FLUSH-MOUNT PIVOTING SPEAKER

[75] Inventors: Edward H. Haase, Riverside; William To, Santa Maria; Robert Pfiefer, Riverside, all of Calif.

[73] Assignee: Speakercraft, Inc., Riverside, Calif.

[21] Appl. No.: 09/226,970

[22] Filed: Jan. 7, 1999

[51] Int. Cl.[7] ..... H04R 25/00

[52] U.S. Cl. ..... 381/386; 381/387; 381/182; 181/153

[58] Field of Search ..... 381/87, 89, 332, 381/304, 305, 182, 186, 371, 386, 387, 390, 395, FOR 151, FOR 165, 86, 389; 181/144, 145, 147, 153, 154, 199

[56] References Cited

U.S. PATENT DOCUMENTS

| | | | |
|---|---|---|---|
| 4,439,643 | 3/1984 | Schweizer . | |
| 4,853,966 | 8/1989 | Skrzycki . | |
| 4,993,510 | 2/1991 | Kato et al. . | |
| 5,109,424 | 4/1992 | Andre et al. | 381/371 |
| 5,133,428 | 7/1992 | Perrson . | |
| 5,319,164 | 6/1994 | Shen | 181/153 |
| 5,400,412 | 3/1995 | King, Sr. et al. . | |
| 5,859,917 | 1/1999 | Silber et al. | 381/386 |
| 5,960,095 | 9/1999 | Chang | 381/387 |

*Primary Examiner*—Huyen Le
*Attorney, Agent, or Firm*—Sheldon & Mak

[57] ABSTRACT

A panel mount speaker system including a housing having flange and wall portions, a locating portion defining a primary support surface as a concave annular spherical segment; a secondary support member defining a secondary support surface as a concave spherical segment opposite a main pivot point; a main speaker mount having an outwardly facing primary engagement surface slidably engaging the primary support surface; a main speaker unit coaxially mounted to the main speaker mount; a secondary mount member fastened to the stator element of the main speaker unit and having an outwardly facing secondary engagement surface slidably engaging the secondary support surface; an auxiliary speaker; a grill structure pivotally supporting the auxiliary speaker forwardly of the main speaker unit; a crossover network connected to the main speaker unit and the auxiliary speaker; a circuit panel mounting elements of the crossover network oriented and supported perpendicular to the housing axis, the panel flexing in response to axial loading of the secondary support member for preloading sliding engagement of the main speaker mount.

13 Claims, 5 Drawing Sheets

FLUSH-MOUNT PIVOTING SPEAKER

BACKGROUND

The present invention relates to panel mount speaker assemblies having directional adjustability, and more particularly to such assemblies having plural transducers.

Panel mount speaker assemblies having one or plural transducers are commonly located in walls and ceilings of building structures. See, for example, U.S. Pat. No. 4,439,643 to Schweizer, U.S. Pat. No. 4,853,966 to Skrzycki, U.S. Pat. No. 4,993,510 to Kato et al., and U.S. Pat. No. 5,400,412 to King et al. U.S. Pat. No. 5,133,428 to Perrson discloses a direction-adjustable speaker system wherein a speaker element is fixedly located within a mount having a partial spherical outer surface, the mount being pivotally supported about a central point by the spherical surface slidably engaging an annular lip of a stationary housing and a ring that is fixed within the housing. A disadvantage of the adjustable speaker of Perrson is that it variably projects from the housing as it is adjusted. Also, the mount is subject to vibration relative to the housing in response to operation of the speaker element. Further, the adjustable mount of Perrson appears to be suitable for singular speaker elements that are small in size.

Thus there is a need for a directionally adjustable panel-mount speaker system that overcomes the disadvantages of the prior art.

SUMMARY

The present invention meets this need by providing a recessed panel mount speaker configuration that is particularly effective in a variety of room environments. In one aspect of the invention, a panel mount speaker system includes a housing having an outwardly extending perimeter flange portion and a rearwardly projecting wall portion surrounding a longitudinal housing axis, a locating portion extending within the wall portion and defining an inwardly facing primary support surface surrounding the housing axis; a secondary support member supported relative to the housing and having a locating portion that defines an inwardly facing secondary support surface surrounding the main axis, the secondary support surface facing toward the primary support surface opposite a main pivot point; a main speaker mount having an outwardly facing primary engagement surface slidably engaging the primary support surface for pivotally locating the main speaker mount relative to a main pivot point on the housing axis; a main speaker unit coaxially mounted to the main speaker mount on a main speaker axis, the main speaker unit having a frame, a stator element, and a transducer element; a secondary mount member supported relative to the main speaker mount and having an outwardly facing secondary engagement surface slidably engaging the secondary support surface for retaining the main speaker mount in pivotable relation to the main pivot point; and main biasing means for preloading the sliding engagement of the primary and secondary engagement surfaces, wherein the primary and secondary engagement surfaces are spaced sufficiently rearwardly relative to the housing that the main speaker mount and the main speaker unit are spaced behind a front extremity of the flange portion of the housing over a full pivot range of the main speaker mount.

The main speaker axis can intersect the main pivot point, the transducer element being positioned forwardly of the stator element. The primary support surface can be a concave annular spherical segment. The secondary support surface can be a concave spherical segment. The primary engagement surface can be a convex annular spherical segment. The secondary engagement surface can be a convex spherical segment.

The main biasing means can include a flexible plate member coupling the secondary support member to the housing, the flexible plate member being oriented proximately perpendicular to the housing axis. The secondary mount member can be fastened to the stator element of the main speaker.

The speaker system can further include an auxiliary speaker; a grill structure extending in fixed relation to the main speaker mount forwardly of the main transducer surface and pivotally supporting the auxiliary speaker. Preferably the system further includes a crossover network connected to the main and auxiliary speakers for driving the main speaker primarily over a first frequency range and driving the auxiliary speaker primarily over a second frequency range in response to an external signal, the second frequency range being higher than the first frequency range. Elements of the crossover network can be mounted on a circuit panel, the main biasing means including the circuit panel being oriented proximately perpendicular to the housing axis and supported by the housing wall portion on opposite sides of the housing axis, the secondary support member being mounted to the circuit panel, the panel flexing in response to axial loading of the secondary support member.

The main speaker can have a nominal frame diameter, the primary support surface being at a first radial distance between 60 percent and 65 percent of the frame diameter, and the flange portion of the housing has an inside diameter being between 140 percent and 150 percent of the frame diameter.

DRAWINGS

These and other features, aspects, and advantages of the present invention will become better understood with reference to the following description, appended claims, and accompanying drawings, where:

DESCRIPTION

Figure 1:
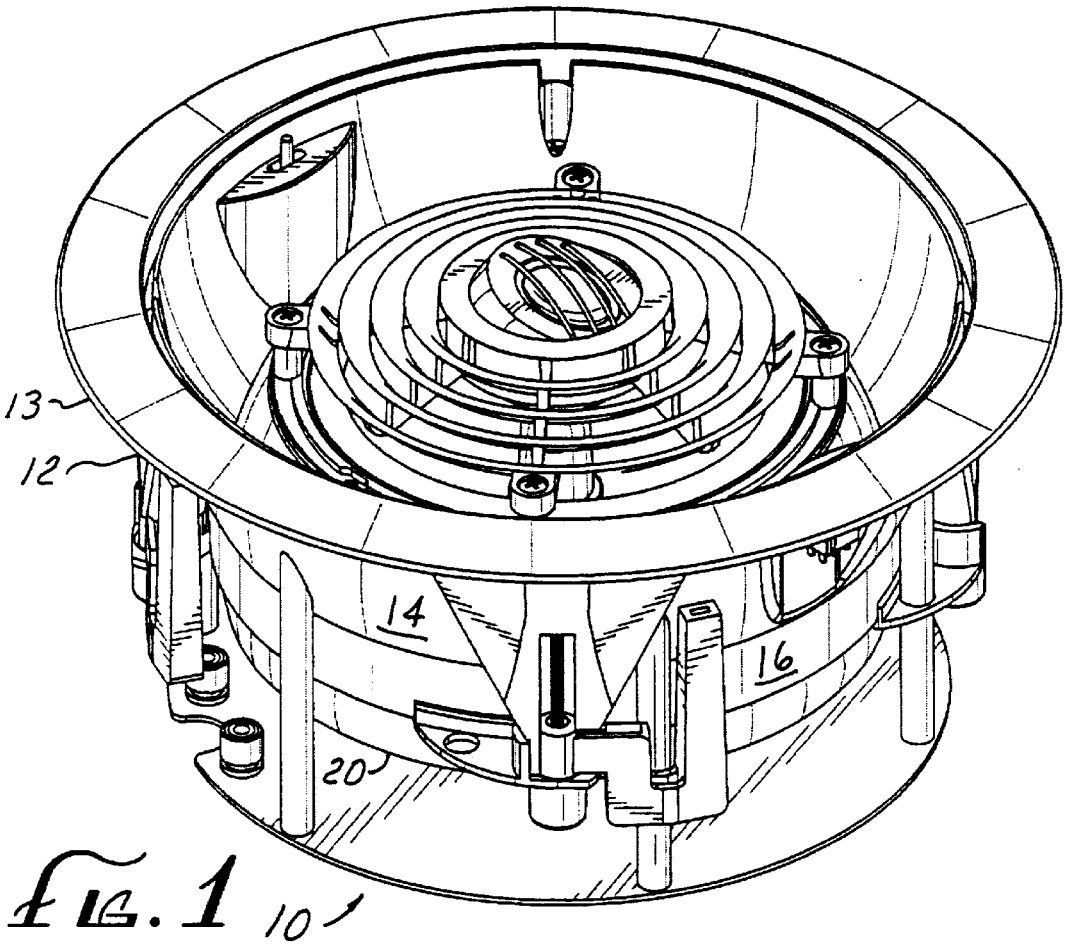
FIG. 1 is a right-front oblique view of a flush-mount pivoting speaker unit according to the present invention.

The present invention is directed to a flush panel mount speaker system that is particularly effective in reproducing sounds within desired room locations. With reference to FIGS. 1–8 of the drawings, a speaker system 10 includes a housing 12 having an outwardly extending flange portion 13 and a rearwardly extending wall portion 14 surrounding a longitudinal housing axis 15. A locating portion 16 of the wall portion defines a rearwardly and inwardly facing primary support surface 18 that is uniformly spaced at a distance R1 from a main pivot point 19 on the housing axis 15. A main speaker mount 20 has an outwardly and forwardly facing primary engagement surface 22 for slidably contacting the primary support surface 18, the mount 20 supporting a generally forwardly facing main speaker unit 24. The primary engagement surface 22 forms an annular spherical segment centered about a main speaker axis 25 that intersects the housing axis 15. Thus the locating portion 16 of the housing 12 in combination with the main speaker mount 20 defines slidable pivotable movement of the main speaker unit 24 about the main pivot point 19. In typical mounting of the housing 12 to a panel member (the flange portion 13 contacting the panel member with the wall portion 14 projecting through an opening of the panel member), the housing axis is horizontal (the panel member being a wall member) or vertical (the panel member being a ceiling member), in which case, forwardly is downwardly. In either case, weight of the main speaker unit 24 is supported by contact between the primary support surface 18 and the primary engagement surface 22 in the exemplary configuration of the housing 12 and the main speaker mount 20 as shown in the drawings. It will be understood that either or both of the primary support surface 18 and the primary engagement surface can be defined by discrete portions of the respective members that are not necessarily spherical. For example, the locating portion 16 can have a conical inside surface, and the main speaker mount 20 can be formed having a plurality of projections that define the main engagement surface 22.

The main speaker unit 24 includes a speaker frame 26 that supports a main transducer element 27 (which can be a conventional speaker cone and coil assembly) and a stator element 28 (typically including a permanent magnet) projecting rearwardly of the transducer element 27 on the main speaker axis 25. A secondary support member 30 is supported relative to the housing 12 behind the main speaker unit 24, a locating portion 32 defining a forwardly and inwardly facing secondary support surface 34. A secondary mount member 36 is affixed to the stator element 28, and having a rearwardly and outwardly extending secondary engagement surface for slidably engaging the secondary support surface 34, the surfaces 34 preferably being spherical segments, located at a distance R2 from the main pivot point 25. In an exemplary configuration, the fastening of the secondary mount member 36 is by clamping to the stator element using a plurality of arm extensions 36A that are fastened to the main speaker mount 20. Alternatively, the member 36 can be joined to the stator element 28 by a suitable adhesive.

According to the present invention, the secondary mount member 36 is biasingly connected to the housing 12 by a panel member that flexes in response to axial loading of the secondary support member 30 as described below.

Figure 6:
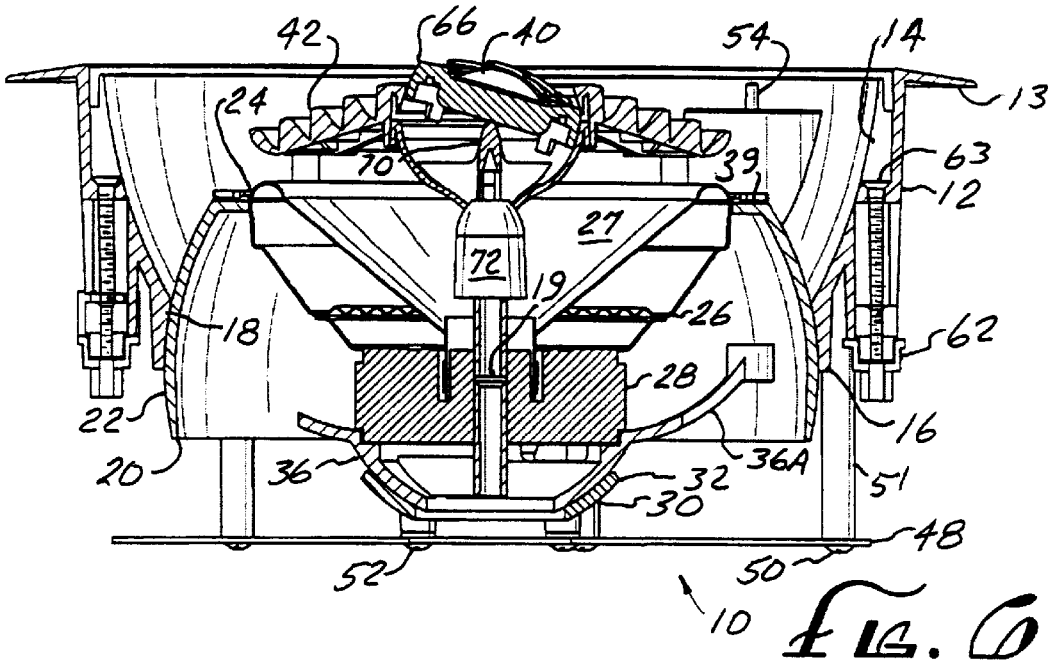
FIG. 6 is a sectional elevational view of the speaker unit of FIG. 1 on line 6—6 of FIG. 4.
Figure 7:
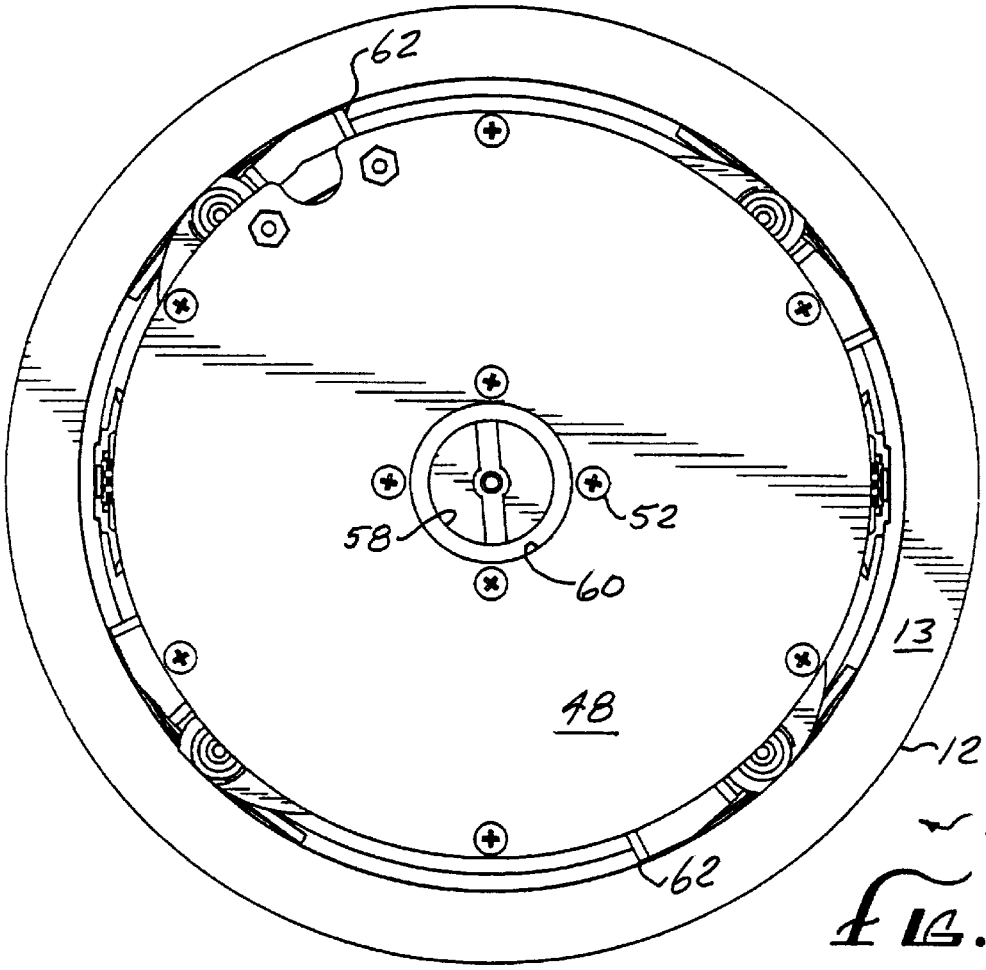
FIG. 7 is a rear view of the speaker unit of FIG. 1.
Figure 8:
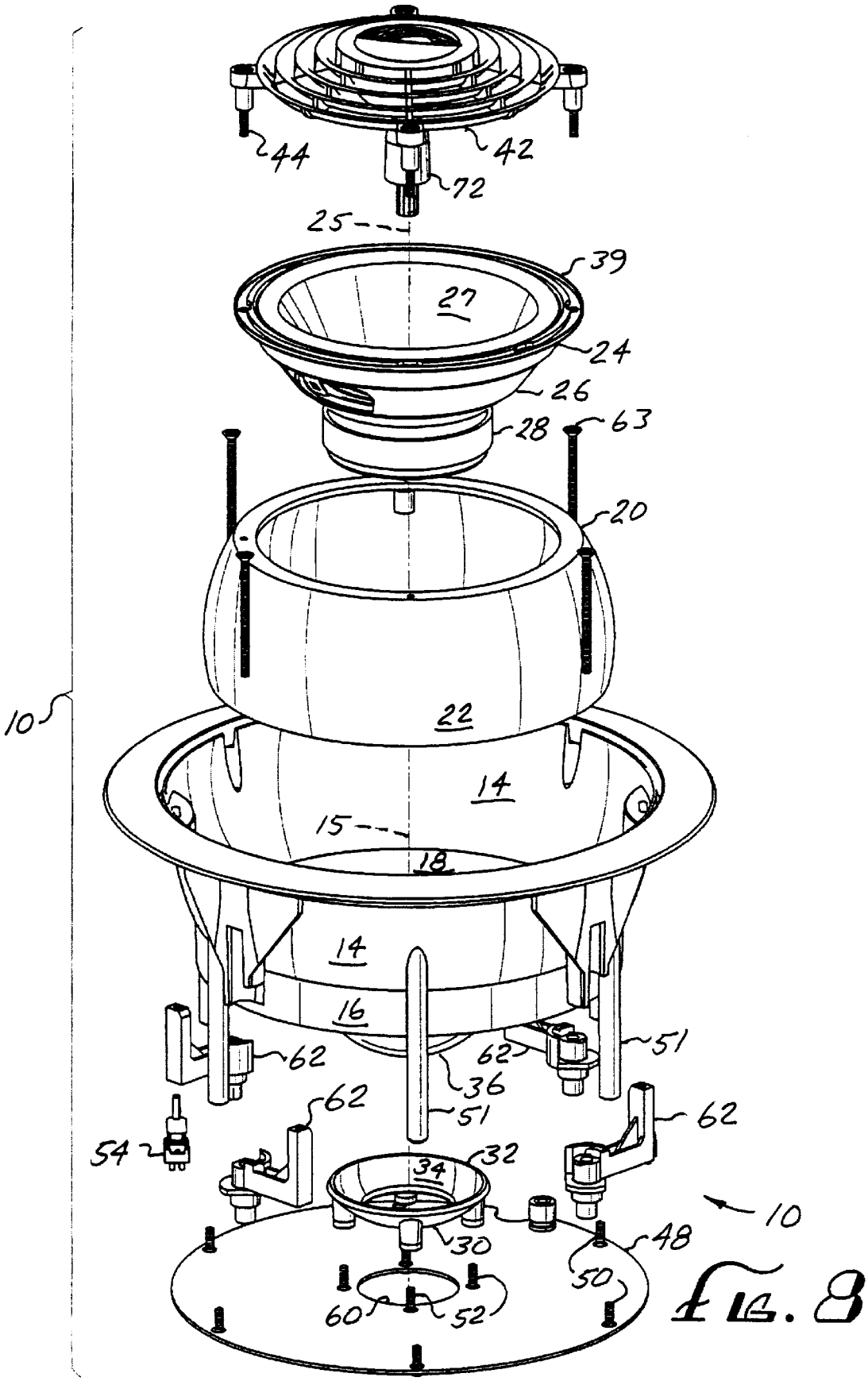
FIG. 8 is an exploded perspective view as in FIG. 3, the speaker unit of FIG. 1 being rotated approximately 135° clockwise.

In further accordance with the present invention, the support surfaces 18 and 34 (and the main pivot point 25) are located sufficiently rearwardly that the main speaker unit does not project forwardly of the housing flange portion 13 throughout its range of pivotable movement. Speakers suitable for use as the main speaker unit 24 as so far described are available from a number of common sources, being typically specified by a nominal size or frame diameter F of 6, 8, 10, or 12 inches. The speaker frame 26 normally has an outwardly projecting flange portion 39 that is clamped to a front extremity of the main speaker mount 20 in any suitable manner, or as described below. Preferably the wall portion 14 of the housing 12 has an inside diameter D proximate the flange portion 13 that is significantly greater than the frame diameter F for facilitating efficient propagation of sound outwardly of the housing 12 over a full range of the pivotal adjustability of the main speaker mount 20. More preferably, the diameter D is between 140 percent and 150 percent of the frame diameter F. As best shown in FIG. 6, the inside of the wall portion 14 is preferably "bowl-shaped" for efficiently directing sound of the main speaker unit 24 outwardly from the housing 12. Also, a preferred proportion of the distance R1 is between 60 percent and 65 percent of the frame diameter F. Further, the housing 12 is formed for receiving an optional screen bezel (not shown) having a suitable sound-transmitting covering. Accordingly, the support surfaces 18 and 34 (and the main pivot point 19) are located sufficiently rearwardly that the main speaker mount 20 and the speaker unit 24 are confined behind a front extremity of the housing 12 throughout a full range of angular adjustment of the speaker unit 24, being approximately 30 degrees in any direction from a centered position wherein the main speaker axis 25 is aligned with the housing axis 19.

A secondary speaker 40 is supported in generally coaxial relation forwardly of the main speaker unit 24 by a grill structure 42, the grill structure being fastened to the main speaker mount 22 by a plurality of grill fasteners 44, the outwardly projecting flange portion 39 of the speaker frame 26 being clamped between the grill structure 42 and the speaker mount 20. The speaker system 10 also includes crossover network 46 for driving the main speaker unit 24 primarily over a first frequency range, and driving the auxiliary speaker 40 primarily over a second and higher frequency range, the respective frequency ranges overlapping at an appropriate crossover frequency according to conventional practice. The crossover network 46 is provided on a circuit panel 48 that is fastened to a rear portion of the housing 13 on opposite sides of the housing axis 15 by a plurality of panel fasteners 50, Each panel fastener 50 threadingly engages a rearwardly extending boss portion 51 of the housing 12, the panel 48 being oriented perpendicular to the housing axis rearwardly of the main speaker unit 24. The secondary support member 30 is also mounted to the circuit panel 46 by a plurality of mount fasteners 52, at locations spaced inwardly from the panel fasteners 50, the panel 46 flexing (elastically bending) in response to axial loading of the secondary support member 30 in slidingly contacting the secondary mount member 36. Thus the circuit panel 46 doubles as means for biasingly preloading the sliding contact at the primary and secondary engagement surfaces 22 and 38.

Figure 2:
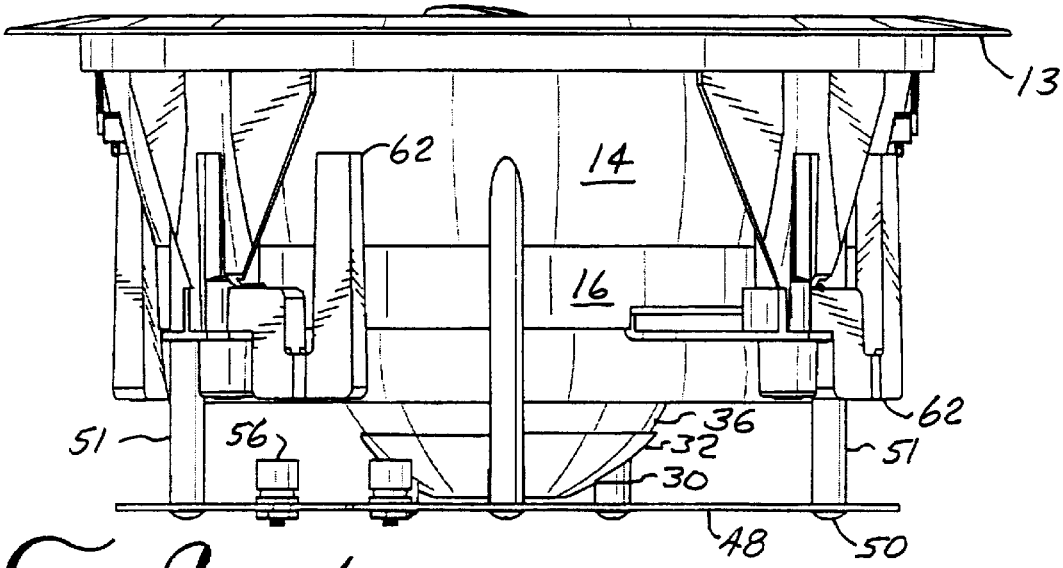
FIG. 2 is a side elevational view of the speaker unit of FIG. 1.
Figure 3:
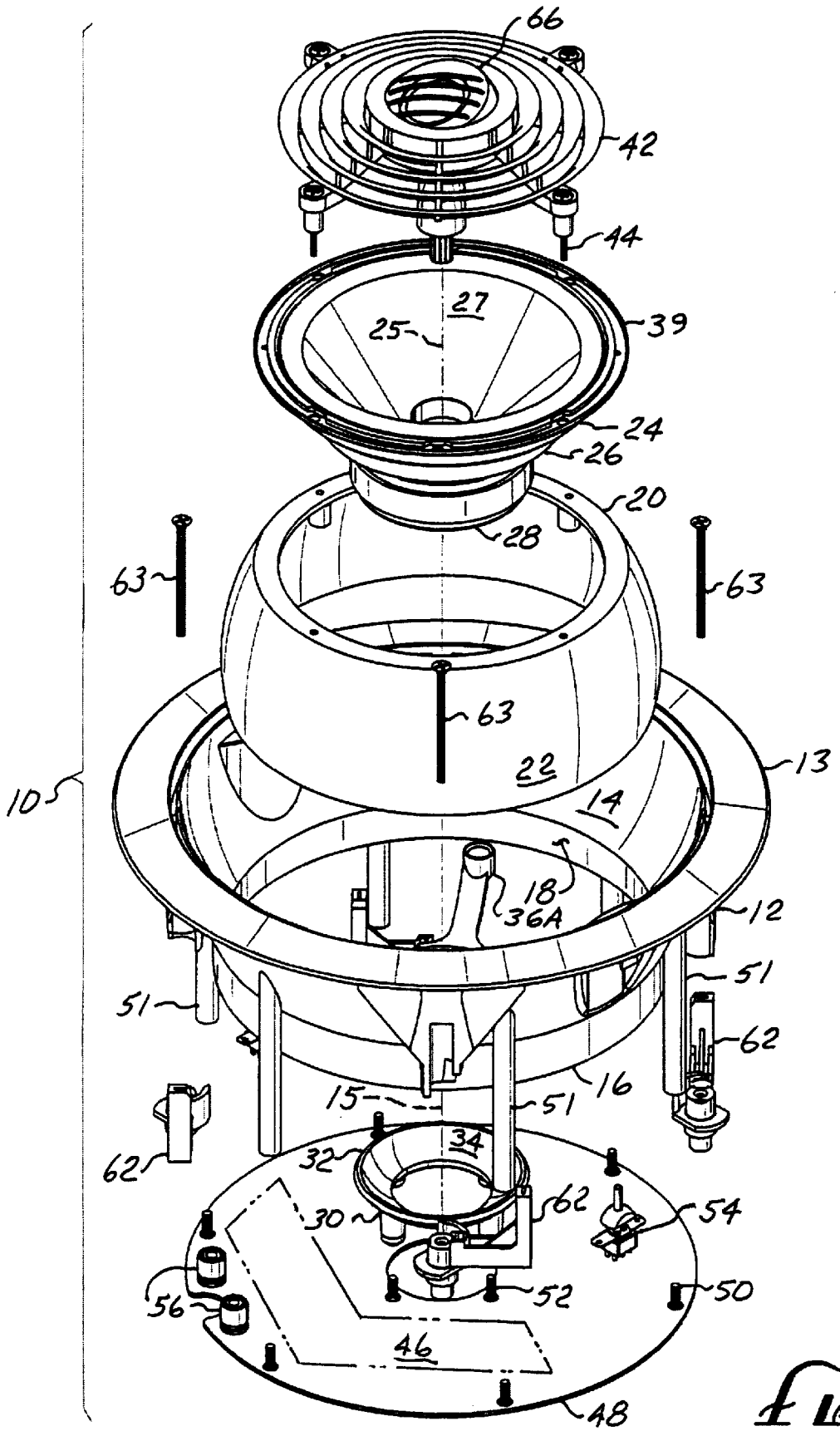
FIG. 3 is an exploded perspective view of the speaker unit of FIG. 1.
Figure 4:
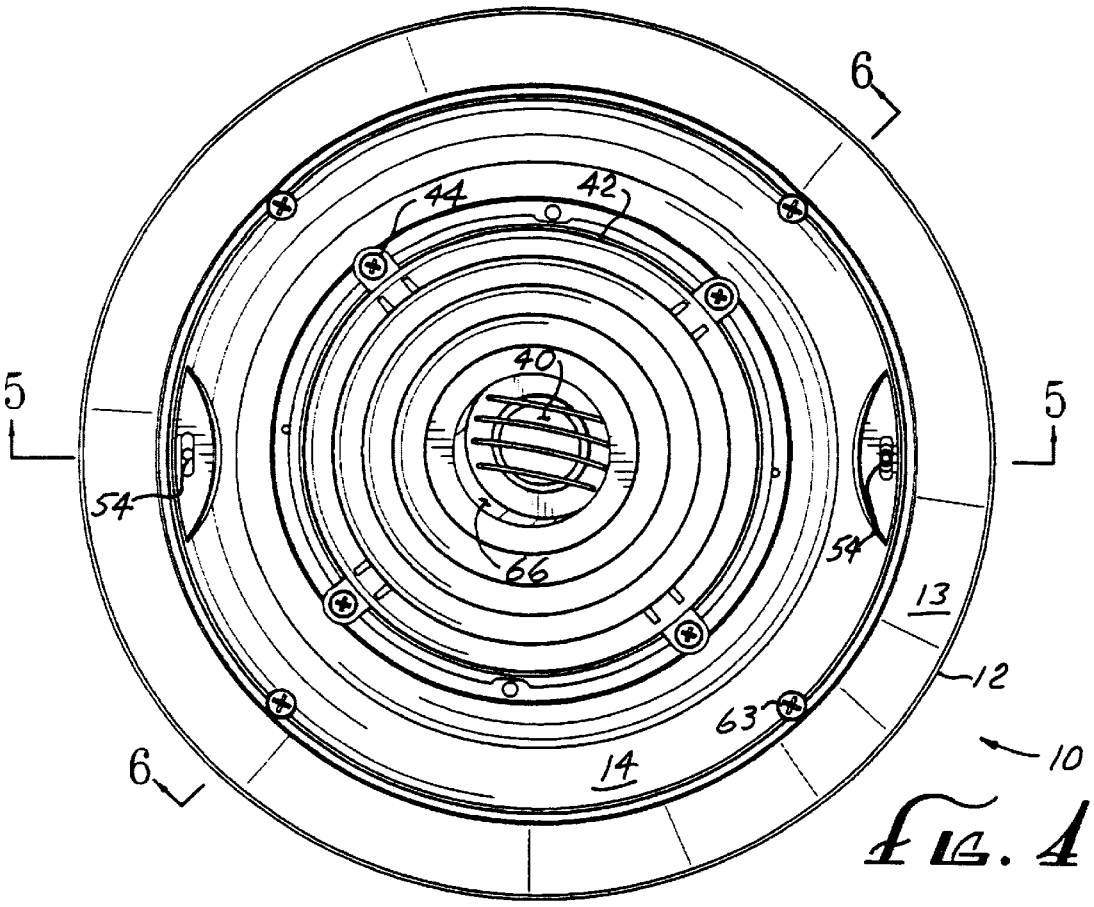
FIG. 4 is a front view of the speaker unit of FIG. 1.
Figure 5:
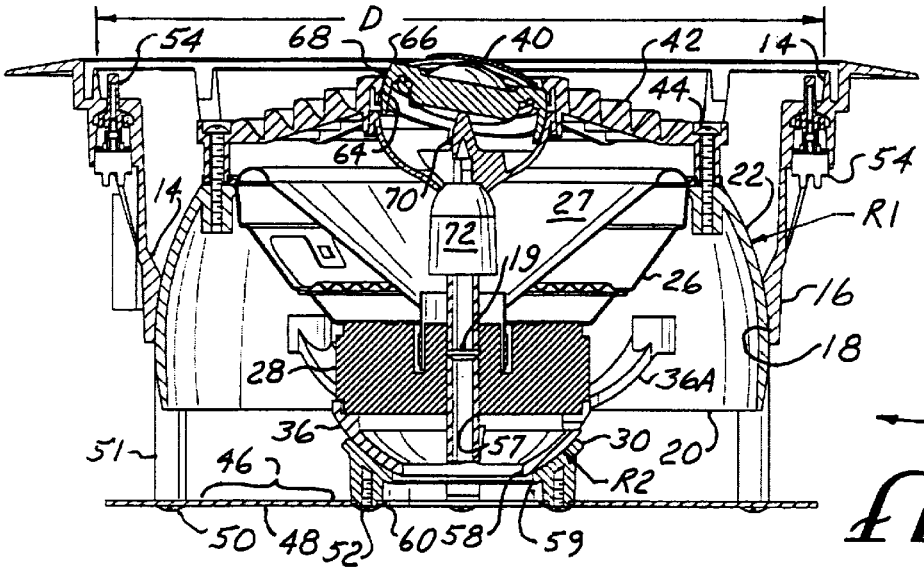
FIG. 5 is a sectional elevational view of the speaker unit of FIG. 1 on line 5—5 of FIG. 4.

Optionally, a pair of user-accessible control elements 54 (which can be switches, variable resistors, potentiometers, for example) are mounted to the housing 12 in a manner permitting adjustment accessibility within the flange portion 13 as best shown in FIGS. 3–5. The control elements 54 are electrically connected to the circuit panel 48 by suitable flexible conductors (not shown), forming appropriate portions of the crossover network 46 and permitting adjustment of the output response of the main speaker unit 24 and/or the auxiliary speaker 40. Also, a pair of input terminals 56 of the crossover network 46 are provided on the circuit panel 48 as shown in FIGS. 1–3. The stator element 28 of the main speaker unit 24 is provided with a central opening 57, and the secondary mount member 36, the secondary support member 30, and the circuit panel 48, are correspondingly formed having respective openings 58, 59, and 60 for passing suitable conductors (not shown) whereby the auxiliary speaker 30 is electrically connected to the crossover network 46 as shown in FIG. 4. Electrical connections to the main speaker unit 24, using additional flexible conductors, can be made directly from the forwardly facing side of the circuit panel 48 to conventional side terminals of the main speaker unit 24.

The speaker system 10 is adapted for being secured to a ceiling or wall panel in that a plurality of swinging clamp arm assemblies 62 are connected to the housing 12 by a corresponding plurality of clamp fasteners 63 in a manner known to those having skill in the art, the arm assemblies 62 slidably engaging corresponding ones of the boss portions for adjustably accommodating various thicknesses of a panel to be clamped between the arm assemblies 62 and the flange portion 13. The clamp fasteners 63 are accessible from within the flange portion 13 of the housing 12 as best shown in FIG. 4.

A principal feature of the present invention is that the auxiliary speaker 40 is itself pivotally adjustable relative to the main speaker unit 24 for improved sound transmission of both high and low frequencies relative to particular room environments. Accordingly, the grill structure 42 is formed having an auxiliary support surface 64 being a spherical annulus, the auxiliary speaker 40 being fastened to an auxiliary mount 66 that is correspondingly formed having a spherically annular auxiliary engagement surface 68 whereby the auxiliary mount has sliding pivotable engagement with the grill structure 42. Also, the auxiliary mount 66 pivotally engages a central pedestal 70 that forms a flexible extremity of an auxiliary support member 72 for biasingly preloading the sliding contact at the auxiliary support surface 64. The auxiliary support member 72 engages the stator opening 57, being thereby supported by the stator element 28 of the main speaker unit 24.

Thus the angular orientation of the auxiliary speaker 40 is adjustable relative to the orientation of the main speaker unit 24, advantageously providing greater flexibility in adapting the speaker system 10 to particular room environments. This is because the spatial interaction with a particular room environment is typically different for sound frequencies coming primarily from the auxiliary speaker 40 than for those frequencies primarily provided from the main speaker unit 24. For example, upholstered furniture typically reflects lower frequency sounds (those coming from the main speaker unit 24) better than high frequency sounds; conversely, hard wall surfaces are better able to reflect high frequency sounds (those coming from the auxiliary speaker 40.

Although the present invention has been described in considerable detail with reference to certain preferred versions thereof, other versions are possible. Therefore, the spirit and scope of the appended claims should not necessarily be limited to the description of the preferred versions contained herein.

What is claimed is:

1. A panel mount speaker system comprising:

(a) a housing having an outwardly extending perimeter flange portion and a rearwardly projecting wall portion surrounding a longitudinal housing axis, a locating portion extending within the wall portion and defining an inwardly facing primary support surface surrounding the housing axis;

(b) a secondary support member supported relative to the housing, a locating portion of the support member defining an inwardly facing secondary support surface surrounding the main axis, the secondary support surface facing toward the primary support surface opposite a main pivot point;

(c) the main speaker mount having an outwardly facing primary engagement surface slidably engaging the primary support surface for pivotally locating the main speaker mount relative to a main pivot point on the housing axis;

(d) a main speaker unit coaxially mounted to the main speaker mount on a main speaker axis, the main speaker unit having a frame, a stator element, and a transducer element;

(e) a secondary mount member supported relative to the main speaker mount and having an outwardly facing secondary engagement surface slidably engaging the secondary support surface for retaining the main speaker mount in pivotable relation to the main pivot point; and (f) main biasing means for preloading the sliding engagement of the primary and secondary engagement surfaces, wherein the primary and secondary engagement surfaces are spaced sufficiently rearwardly relative to the housing that the main speaker mount and the main speaker unit are spaced behind a front extremity of the flange portion of the housing over a full pivot range of the main speaker mount.

2. The speaker system of claim 1, wherein the main speaker axis intersects the main pivot point, the transducer element being positioned forwardly of the stator element.

3. The speaker system of claim 2, wherein the primary support surface is a concave annular spherical segment.

4. The speaker system of claim 2, wherein the secondary support surface is a concave spherical segment.

5. The speaker system of claim 2, wherein the primary engagement surface is a convex annular spherical segment.

6. The speaker system of claim 2, wherein the secondary engagement surface is a convex spherical segment.

7. The speaker system of claim 1, wherein the main biasing means comprises a flexible plate member coupling the secondary support member to the housing, the flexible plate member being oriented proximately perpendicular to the housing axis.

8. The speaker system of claim 1, wherein the secondary mount member is fastened to the stator element of the main speaker unit.

9. The speaker system of claim 1, further comprising:

(a) an auxiliary speaker;

(b) a grill structure extending in fixed relation to the main speaker mount forwardly of the main transducer surface, the grill structure pivotally supporting the auxiliary speaker.

10. The speaker system of claim 9, further comprising a crossover network connected to the main speaker unit and the auxiliary speaker for driving the main speaker unit primarily over a first frequency range and driving the auxiliary speaker primarily over a second frequency range in response to an external signal, the second frequency range being higher than the first frequency range.

11. The speaker system of claim 10, wherein elements of the crossover network are mounted on a circuit panel, the main biasing means comprising the circuit panel being oriented proximately perpendicular to the housing axis and supported by the housing wall portion on opposite sides of the housing axis, the secondary support member being mounted to the circuit panel, the panel flexing in response to axial loading of the secondary support member.

12. The speaker system of claim 1, wherein the main speaker unit has a nominal frame diameter, the primary support surface being at a first radial distance between 60 percent and 65 percent of the frame diameter, and the flange portion of the housing has an inside diameter being between 140 percent and 150 percent of the frame diameter.

13. A panel mount speaker system comprising:

(a) a housing having an outwardly extending perimeter flange portion and a rearwardly projecting wall portion surrounding a longitudinal housing axis, a locating portion extending within the wall portion and defining an inwardly facing primary support surface surrounding the housing axis, the primary support surface being a concave annular spherical segment;

(b) a secondary support member supported relative to the housing, a locating portion of the support member defining an inwardly facing secondary support surface surrounding the main axis, the secondary support surface being a concave spherical segment and facing toward the primary support surface opposite a main pivot point;

(c) a main speaker mount having an outwardly facing primary engagement surface slidably engaging the primary support surface for pivotally locating the main speaker mount relative to the main pivot point on the housing axis, the primary engagement surface being a convex annular spherical segment;

(d) a main speaker unit coaxially mounted to the main speaker mount on a main speaker axis, the main speaker unit including a frame having a nominal frame diameter, a stator element, and a transducer element, the main speaker axis intersecting the main pivot point, the transducer element being positioned forwardly of the stator element, the primary support surface being at a first radial distance between 60 percent and 65 percent of the frame diameter, and the flange portion of the housing has an inside diameter being between 140 percent and 150 percent of the frame diameter;

(e) a secondary mount member fastened to the stator element of the main speaker unit and having an outwardly facing secondary engagement surface slidably engaging the secondary support surface for retaining the main speaker mount in pivotable relation to the main pivot point, the secondary engagement surface being a convex spherical segment;

(f) an auxiliary speaker;

(g) a grill structure extending in fixed relation to the main speaker mount forwardly of the main transducer surface, the grill structure pivotally supporting the auxiliary speaker, the grill structure and the secondary speaker remaining spaced rearwardly of the flange portion of the housing during angular adjustment of the main speaker mount and the secondary speaker;

(h) a crossover network connected to the main and auxiliary speakers for driving the main speaker unit primarily over a first frequency range and driving the auxiliary speaker primarily over a second frequency range in response to an external signal, the second frequency range being higher than the first frequency range;

(i) a circuit panel having elements of the crossover network mounted thereon, the circuit panel being oriented proximately perpendicular to the housing axis and supported by the housing wall portion on opposite sides of the housing axis, the secondary support member being mounted to the circuit panel, the panel flexing in response to axial loading of the secondary support member for preloading the sliding engagement of the primary and secondary engagement surfaces, wherein the primary and secondary engagement surfaces are spaced sufficiently rearwardly relative to the housing that the main speaker mount, the grill structure, and the main speaker unit are spaced behind a front extremity of the flange portion of the housing over a full pivot range of the main speaker mount.

* * * * *